US009544963B2

(12) United States Patent
Chang et al.

(10) Patent No.: US 9,544,963 B2
(45) Date of Patent: Jan. 10, 2017

(54) SELF-EXCITED TRIAC DIMMING CIRCUIT

(71) Applicant: UNITY OPTO TECHNOLOGY CO., LTD., New Taipei (TW)

(72) Inventors: Wei Chang, New Taipei (TW); Chih-Hsien Wu, New Taipei (TW); Kai-Cheng Chuang, New Taipei (TW); Shao-Wei Chiu, New Taipei (TW); Cheng-Han Hung, New Taipei (TW)

(73) Assignee: Unity Opto Technology Co., Ltd., New Taipei (TW)

( * ) Notice: Subject to any disclaimer, the term of this patent is extended or adjusted under 35 U.S.C. 154(b) by 0 days.

(21) Appl. No.: 14/464,824

(22) Filed: Aug. 21, 2014

(65) Prior Publication Data

US 2015/0351184 A1 Dec. 3, 2015

(30) Foreign Application Priority Data

May 30, 2014 (TW) ..... 103209581 U

(51) Int. Cl.
*H05B 33/08* (2006.01)

(52) U.S. Cl.
CPC ..... *H05B 33/0845* (2013.01); *H05B 33/0815* (2013.01)

(58) Field of Classification Search
CPC ..... H05B 37/02; H05B 33/08; H05B 33/0815; H05B 33/0845; H05B 33/0809
USPC ..... 315/186, 219, 247, 291, 294, 297, 307, 315/308, 312
See application file for complete search history.

(56) References Cited

U.S. PATENT DOCUMENTS

2011/0012530 A1* 1/2011 Zheng ..... H05B 33/0815 315/294
2011/0285301 A1* 11/2011 Kuang ..... H05B 33/0845 315/200 R
2011/0285308 A1* 11/2011 Crystal ..... H05B 33/0815 315/287
2012/0319605 A1* 12/2012 Choi ..... H05B 33/0815 315/201
2014/0077713 A1* 3/2014 Otake ..... H05B 33/0818 315/200 R

* cited by examiner

*Primary Examiner* — Thai Pham
(74) *Attorney, Agent, or Firm* — Rosenberg, Klein & Lee

(57) ABSTRACT

A self-excited TRIAC dimming circuit applied in a panel light includes a dimming module and at least one conversion module, and a power factor controller (PFC) is installed in the dimming module, and the conversion module is a self-excited electronic isolation transformer, and the TRIAC PFC is integrated with the circuit structure of a self-excited electronic transformer to improve the overall circuit stability, so that the panel light complies with a high safety standard to enhance product applicability and competitiveness.

1 Claim, 7 Drawing Sheets

SELF-EXCITED TRIAC DIMMING CIRCUIT

CROSS-REFERENCE TO RELATED APPLICATIONS

This non-provisional application claims priority under 35 U.S.C. §119(a) on Patent Application No(s). 103209581 filed in Taiwan, R.O.C. on May 30, 2014, the entire contents of which are hereby incorporated by reference.

BACKGROUND OF THE INVENTION

1. Field of the Invention

The present invention relates to the technical field of a self-excited power conversion circuit, and more particularly to a self-excited TRI-electrode AC switch (TRIAC) dimming circuit applied in a panel light. and a self-excited electronic transformer is provided for simplifying the driving circuit structure in the panel light to lower the product cost, so as to improve the product competitiveness.

2. Description of the Related Art

To create a comfortable, bright and stylish reading space or working space, panel lights with a simple and elegant shape are installed to an interior ceiling. To drive the operation of the panel light, a driving circuit is generally installed between a main circuit and a control circuit of the panel light for converting utility power to output a working voltage required by a load, and an insulation circuit installed between the panel lights and the load has a function of controlling the current of the output voltage.

With reference to FIG. 1 for a driving circuit 1 of a conventional panel light, the driving circuit is a non-insulation boost power converter, comprising an inductor (L), a diode (D), a capacitor (C), a switch 10, a detection resistor (RS) and a PWM controller 11, and the inductor connected in series with an anode of the diode is coupled to a drain of the switch 10, and the PWM controller 11 is coupled to a gate and a source of the switch 10 and the detection resistor, and a cathode of the diode is coupled to the capacitor and then electrically coupled to at least one LED 12. The inductor receives an input voltage (Vin), and the input voltage is used for storing power when the switch 10 is electrically conducted, and the stored power and the input voltage are filtered by the capacitor and transmitted to the LED 12 when the switch 10 is cut off, so that the boosting effect of the driving circuit is achieved through the simple and low-cost driving circuit 1, and the low-voltage circuit structure successfully drives the LED 12 to emit light. As to the non-isolation power converter, the precision of a constant current effect is very low, and thus having the issues of safety and electromagnetic compatibility (EMC) and failing to comply with the dimming requirements of the present panel lights.

On the other hand, the self-excited driving circuit of a conventional incandescent lamp or a conventional halogen lamp has an isolation circuit structure and do not have the aforementioned issues. Such self-excited driving circuit achieves the direct conversion effect by a half-bridge resonant circuit and has the advantages and features of quick start, non-flickering, universally applicable for power circuits of different powers, simple structure and low cost. Although the structure of the self-excited driving circuit is simple, it is lack of a constant power control mechanism, so that the output power will increase with the input voltage, and the lamp is unable to maintain a constant brightness, and the lamp has a fast ageing problem.

In view of the aforementioned problems of the conventional self-excited driving circuit applied in a panel light, it is a main subject of the present invention to provide a solution to the safety issue of the non-isolation converter, improve the scope of applicability of the lamp, and improving the output stability of a circuit power while maintaining the simple structure.

SUMMARY OF THE INVENTION

In view of the aforementioned problems of the prior art, it is a primary objective of the present invention to overcome the problems by providing a self-excited TRIAC dimming circuit with a high product competitiveness in the market, so as to comply with the application requirements such as providing a panel light with a driving circuit that supports dimming and multi-output functions. and having the features of low cost and high applicability.

To achieve the aforementioned objective, the present invention provides a self-excited TRIAC dimming circuit comprising a dimming module and at least one conversion module, wherein the conversion module is electrically coupled to the dimming module for receiving an input voltage, converting the input voltage into a driving voltage, and supplying the driving voltage to at least one LED to drive the LED to emit light, characterized in that the dimming module includes a power factor controller installed therein, and the conversion module is a self-excited electronic isolation transformer and has at least one output controller, and the conversion module is electrically coupled to the LED through the output controller, and the output controller is provided for modulating the driving voltage to stabilize the overall circuit output power.

Wherein, the output controller is a current limiting resistor or a control chip for receiving the driving voltage to stabilize the current flowing into the LED, and at least one of the conversion module and the output controller comes with a plural quantity.

Further, the control chip includes a comparison unit and a modulation unit, and the modulation unit has an end electrically coupled to a self-excited electronic isolation transformer for receiving the input voltage and the other end electrically coupled to the LED for outputting the driving voltage, and the comparison unit uses a detector electrically coupled to the LED to detect and obtain a detection value and then compares at least one reference value with the detection value to output a modulation signal, so as to trigger the modulation unit to module a duty cycle for outputting the driving voltage.

In summation of the description above, the present invention integrates a TRIAC PFC with the circuit structure of a self-excited electronic transformer to enhance the overall circuit stability, so that the panel light complies with a high safety standard, and the self-excited TRIAC dimming circuit concurrently has the advantages of low cost and high product competitiveness to facilitate the industrial and economic developments.

DETAILED DESCRIPTION OF THE PREFERRED EMBODIMENTS

The technical content of the present invention will become apparent with the detailed description of preferred embodiments and the illustration of related drawings as follows.

Figure 1:
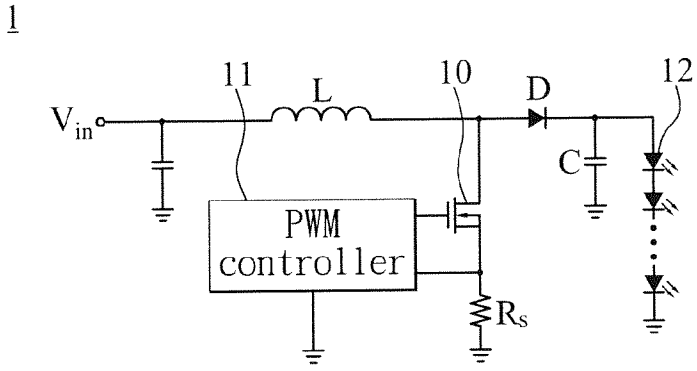
FIG. 1 (PRIOR ART)
FIG. 1 is a circuit diagram of a driving circuit in a conventional panel light.
Figure 2:
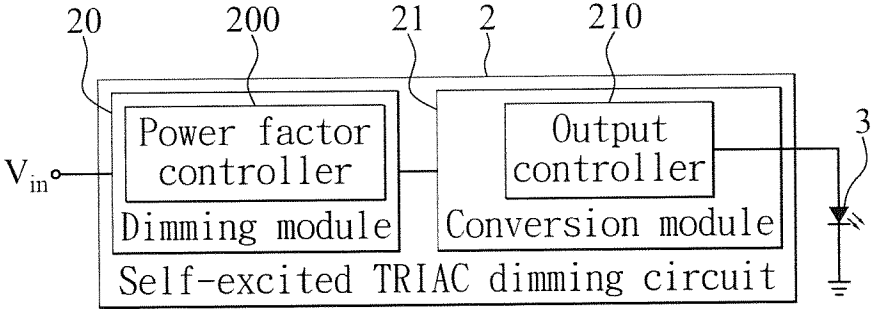
FIG. 2 is a block diagram of a preferred embodiment of the present invention.
Figure 3:
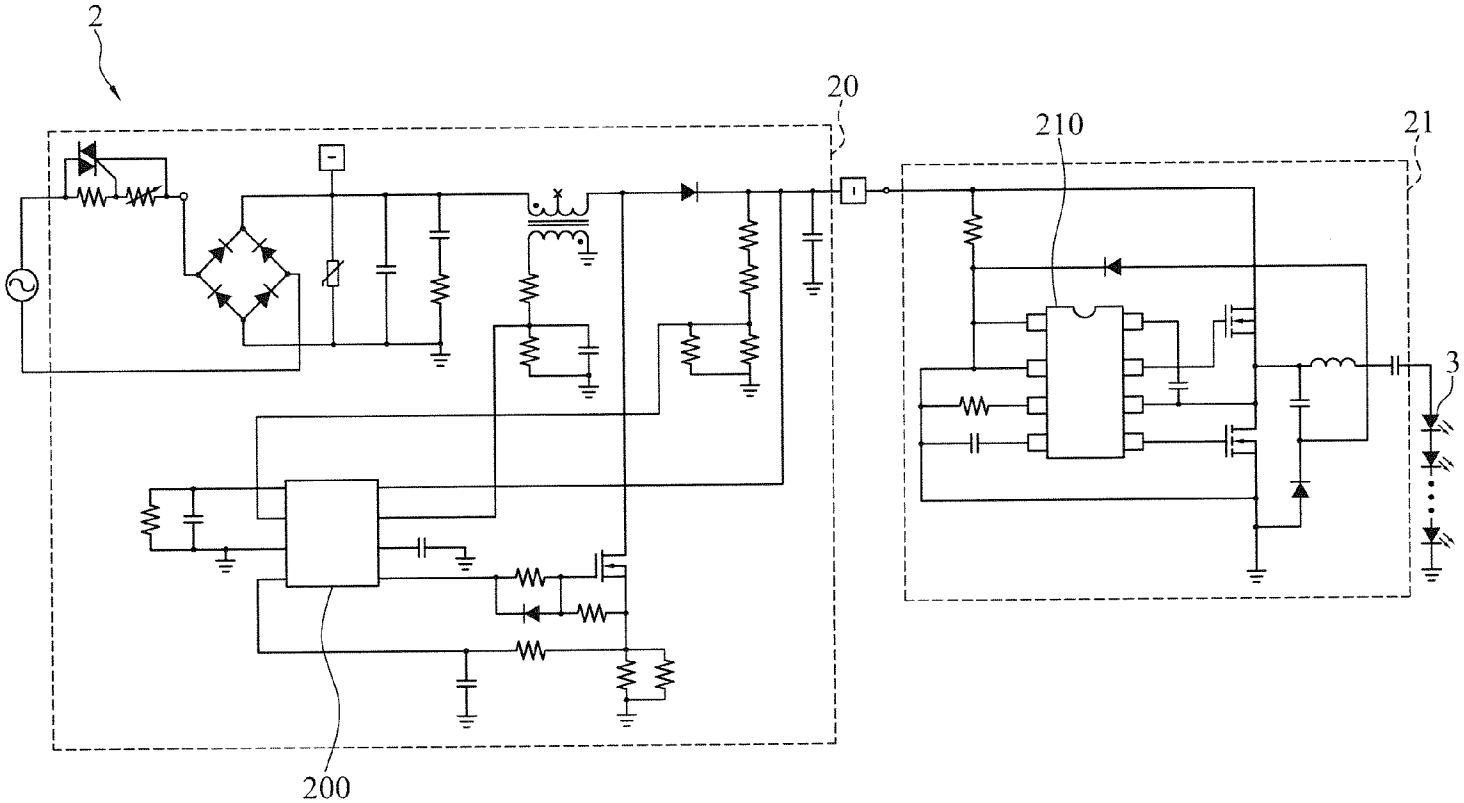
FIG. 3 is a circuit diagram of a preferred embodiment of the present invention.

With reference to FIGS. 2 and 3 for a block diagram and a circuit diagram of a preferred embodiment of the present invention respectively, the self-excited TRIAC dimming circuit 2 is applied in a panel light to supply a driving voltage to at least one LED 3, so as to drive the LED 3 to emit light and adjust the brightness of the light emitted by the LED 3. The self-excited TRIAC dimming circuit 2 comprises a dimming module 20 and at least one conversion module 21, wherein a power factor controller 200 is installed in the dimming module 20 and electrically coupled to the conversion module 21 for adjusting the power factor of the overall circuit when receiving utility power of 120V and performing phase angle shift and power conversion, so as to output an output voltage (Vin) of 200V to the conversion module 21. The conversion module 21 is a self-excited electronic isolation transformer and has at least one output controller 210, and the conversion module 21 is electrically coupled to the LED 3 through the output controller 210, and the conversion module 21 converts the input voltage into a constant driving voltage of 48V or a variable driving voltage of 60V and then outputs the driving voltage to the LED 3, while the output controller 210 modulates the driving voltage to stabilize the overall circuit output power.

Figure 4:
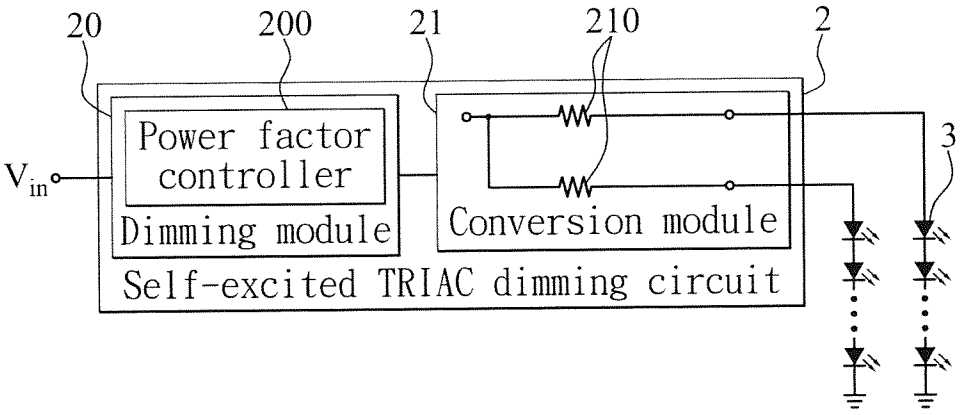
FIG. 4 is a block diagram of a first implementation mode of a preferred embodiment of the present invention.
Figure 5:
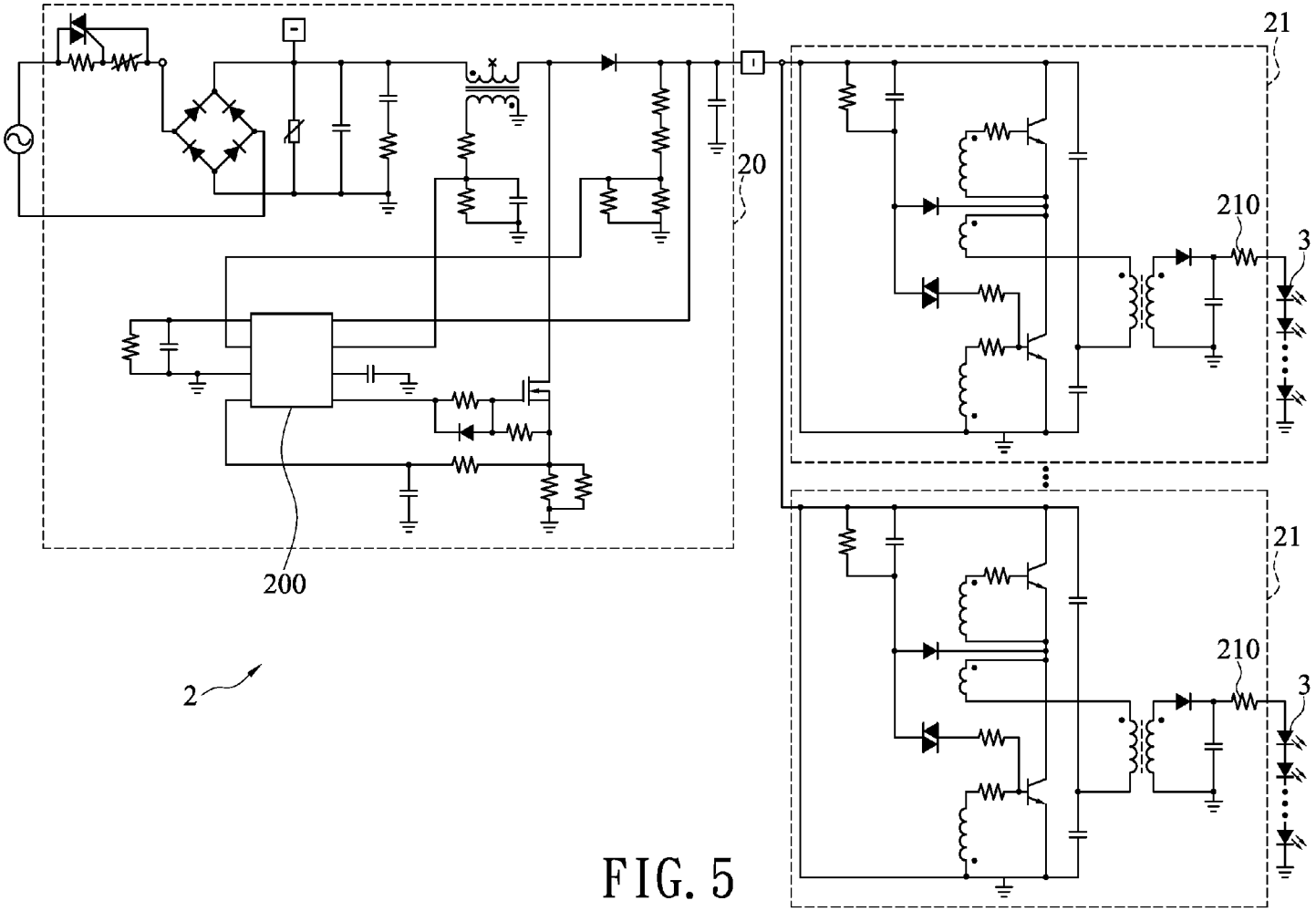
FIG. 5 is a circuit diagram of the first implementation mode of a preferred embodiment of the present invention.
Figure 6:
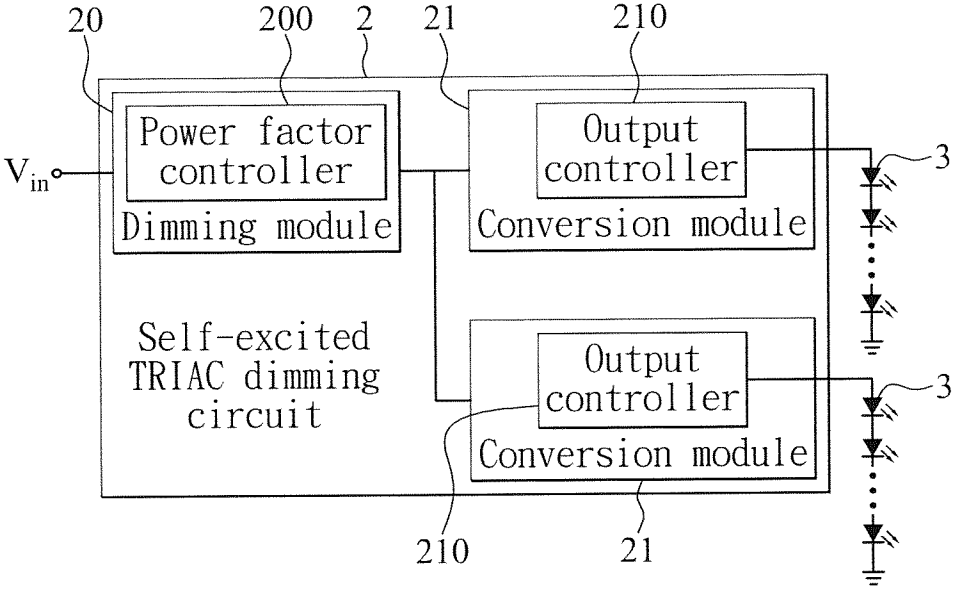
FIG. 6 is a block diagram of a second implementation mode of a preferred embodiment of the present invention.
Figure 7:
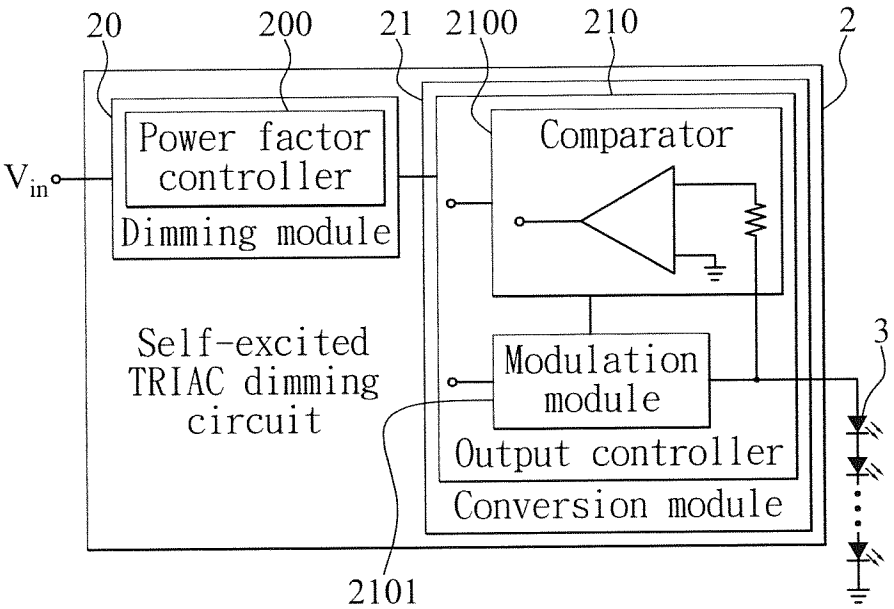
FIG. 7 is a block diagram of a third implementation mode of a preferred embodiment of the present invention.

In FIGS. 4 to 6, the output controller 210 may be a current limiting resistor or a control chip for receiving the driving voltage to stabilize the current flowing into the LED, and at least one of the conversion module 21 and the output controller 210 comes with a plural quantity. In other words, there are output controllers 210 installed in the conversion module 21 and electrically coupled through the current limiting resistors and having the LEDs 3, or the conversion module 21 includes a plurality of self-excited electronic isolation transformers electrically coupled to the LEDs 3 respectively through the current limiting resistor or the control chip. In addition, the control chip as shown in FIG. 6 includes a comparison unit 2100 and a modulation unit 2101, wherein the modulation unit 2101 has an end electrically coupled to the self-excited electronic isolation transformer for receiving the input voltage and the other end electrically coupled to the LED 3 for outputting the driving voltage. and the comparison unit 2100 is electrically coupled to the LED 3 through a detector to obtain a detection value and then compare at least one reference value with the detection value to output a modulation signal, so as to trigger the modulation unit 2101 to modulate a duty cycle for outputting the driving voltage.

What is claimed is:

1. A self-excited TRIAC dimming circuit, consisting of a dimming module and at least one conversion module electrically coupled to the dimming module for receiving an input voltage, converting the input voltage into a driving voltage, and supplying the driving voltage to at least one LED to drive the LED to emit light, characterized in that the dimming module includes a power factor controller installed therein, and the conversion module is a self-excited electronic isolation transformer and has at least one output controller, and the conversion module is electrically coupled to the LED through the output controller, and the output controller is provided for modulating the driving voltage to stabilize the overall circuit output power, wherein the output controller is a current limiting resistor for receiving the driving voltage to stabilize the current flowing into the LED, wherein the dimming module and each of the at least one conversion module is connected via only one terminal respectively, the conversion module includes a plurality of self-excited electronic isolation transformers electrically coupled to the LED respectively through the current limiting resistor.

* * * * *